United States Patent [19]

Arens et al.

[11] Patent Number: 4,800,918

[45] Date of Patent: Jan. 31, 1989

[54] TUBE SEPARATOR

[75] Inventors: Hans Arens, Wertingen; Hans Kern, Vachendorf; Richard Haslberger, Hufschlag, all of Fed. Rep. of Germany

[73] Assignee: Grunbeck Wasseraufbereitung GmbH, Hochstadt, Fed. Rep. of Germany

[21] Appl. No.: 640,653

[22] Filed: Aug. 14, 1984

[51] Int. Cl.[4] ..... F16K 31/122

[52] U.S. Cl. ..... 137/488; 137/492.5

[58] Field of Search ..... 137/102, 107, 492, 492.5, 137/488, 510

[56] References Cited

U.S. PATENT DOCUMENTS

| | | | |
|---|---|---|---|
| 1,688,586 | 10/1928 | Lewis | 137/510 X |
| 2,474,772 | 6/1949 | Ashton | 137/492.5 X |
| 2,588,284 | 3/1952 | Otis . | |
| 3,173,439 | 3/1985 | Griswold . | |
| 3,272,218 | 9/1966 | Johnson | 137/102 |
| 4,186,766 | 2/1980 | Snyder | 137/492.5 X |

FOREIGN PATENT DOCUMENTS

| | | |
|---|---|---|
| 1279563 | 6/1962 | Fed. Rep. of Germany . |
| 7720375 | 3/1979 | Fed. Rep. of Germany . |
| 2801019 | 8/1979 | Fed. Rep. of Germany . |
| 586166 | 3/1947 | United Kingdom . |

*Primary Examiner*—Alan Cohan

*Attorney, Agent, or Firm*—Donald Brown

[57] ABSTRACT

A tube separator (1) having a shut-off means for separating an inlet side (2) from an outlet side (3) is provided. In order to prevent flutter of the shut-off means (4) in a pressure region changing over the shut-off means, a control valve (10) controlling the shut-off means (4) is provided. The control valve (10) is designed such that the pressure required for changing over from a first opened position to a second shut-off position is smaller than the pressure for changing over from the second into the first position.

3 Claims, 2 Drawing Sheets

TUBE SEPARATOR

The invention refers to a tube separator or backflow preventing device comprising shut-off means for separating an inlet side from an outlet side.

A tube separator of this kind is known from the DE-OS No. 28 01 019. In this known tube separator the control valve must shut off the main stream of the medium, which leads to a size of the control valve which is considerable and which varies according to the design conditions. Furthermore, the problem is encountered that the control valve tends to flutter. Thus, it may happen that the shut-off means is not in a defined position.

It is the object of the invention to provide an improved tube separator. In particular the control valve shall be usable independent of the tube diameter. Furthermore, the positioning of the shut-off means into shutting off or releasing shall be well-defined. According to a development of the invention the control valve shall be adjustable to the actual operational conditions.

This object is achieved by a tube separator of the above mentioned kind which according to the invention is characterized in that means for moving the shut-off means in dependence of the fluid pressure at the inlet side as well as a control valve connecting the shut-off means with the inlet side in a first switch position thereof and in a second position with a space in which a pressure prevails which is below the fluid pressure at the inlet side required for changing over the control valve from the first position into the second position, are provided and that the control valve is designed such that the pressure required for switching over the control valve from the first position into the second position is lower than the pressure for changing over from the second into the first position.

Further developments of the invention are characterized in the subclaims.

Figure 1:
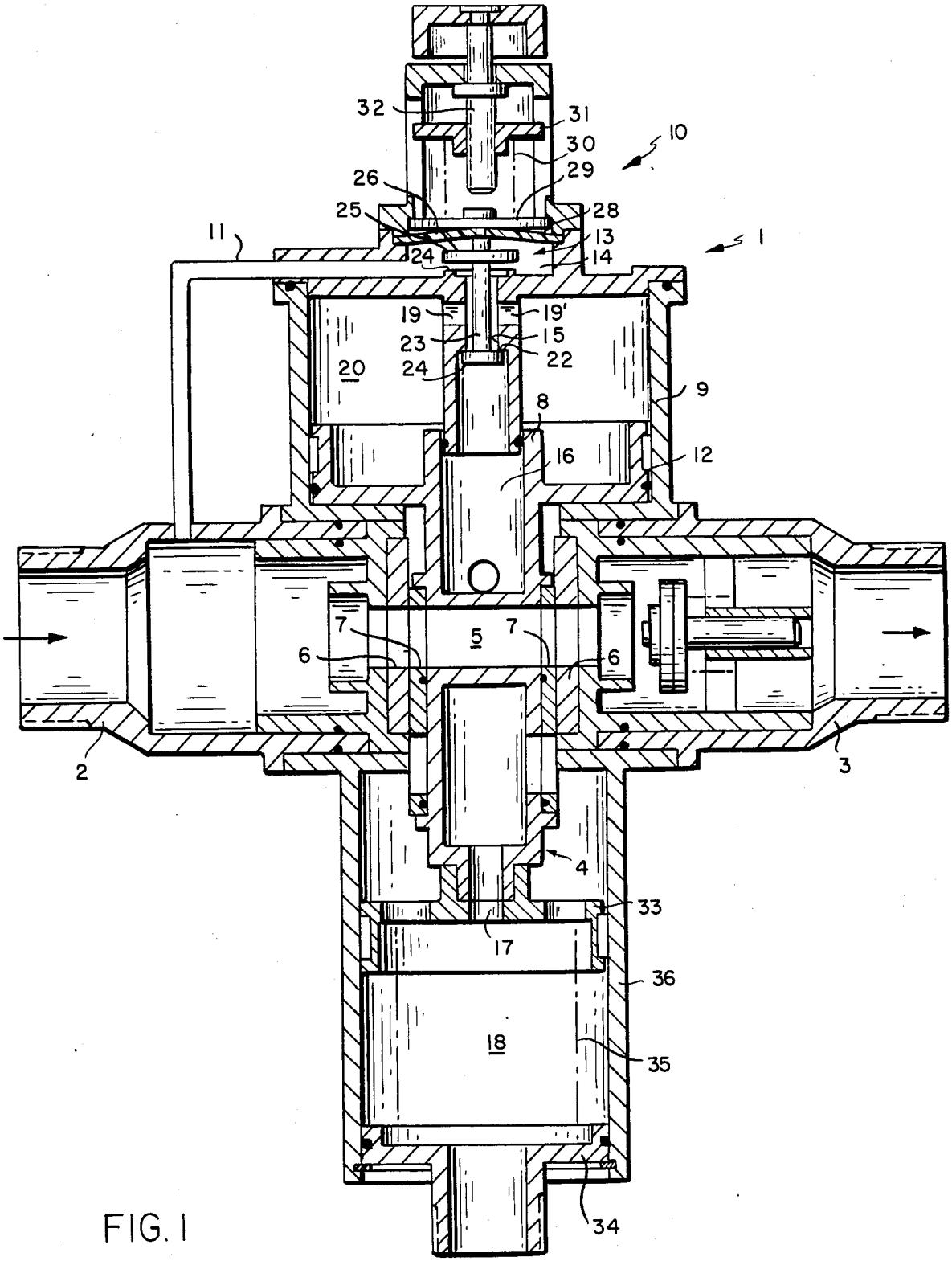
Figure 2:
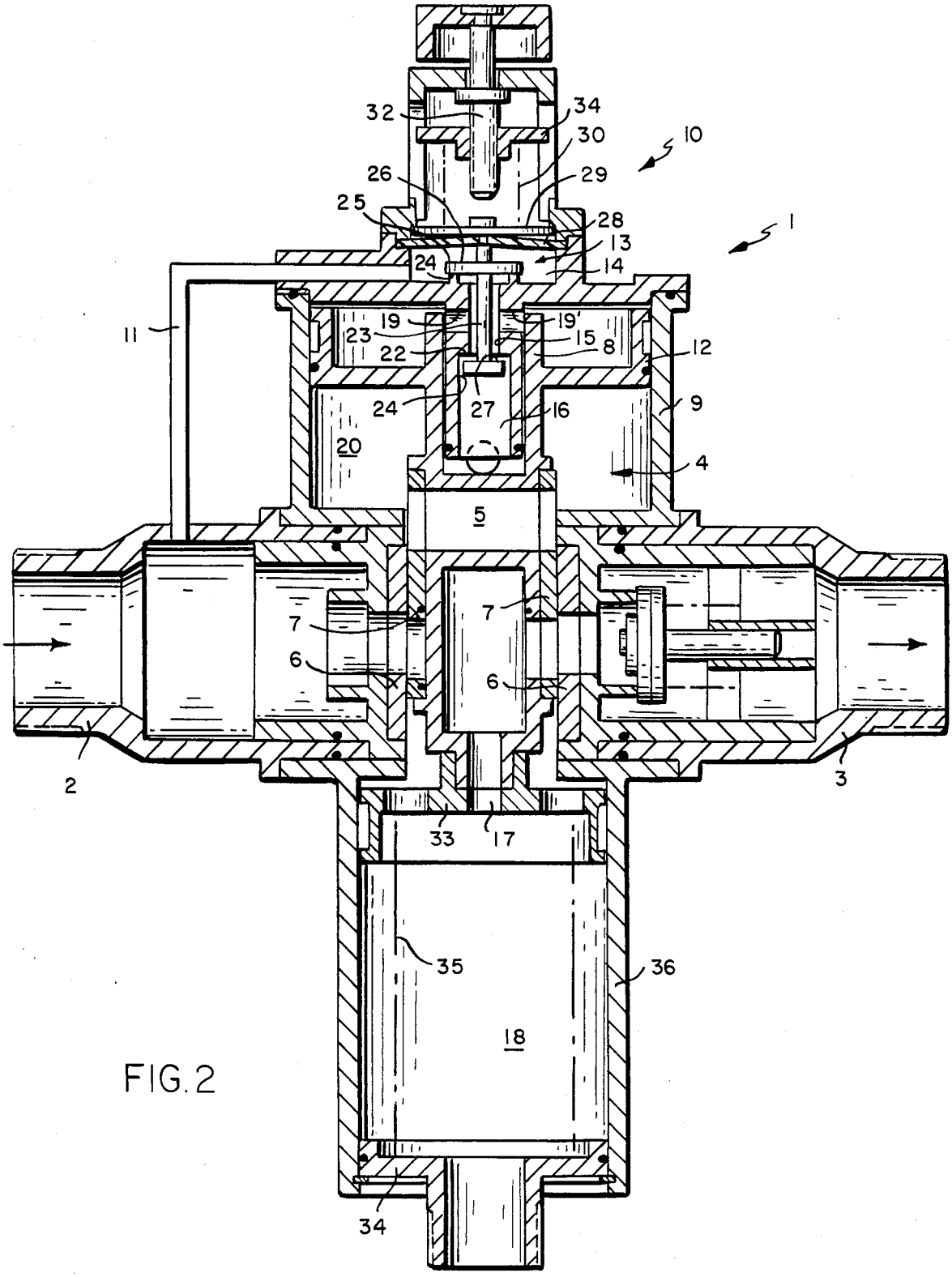

Further features and advantages of the invention will stand out from the description of an embodiment in connection with the figures. In the figures:

FIG. 1 is a sectional view of the tube separator with shut-off means and control valve in the first position; and FIG. 2 is a sectional view of the tube separator with shut-off means and control valve in a second position.

The tube separator 1 comprises an inlet 2 connectable with a tube and an outlet 3 connectable with a tube. A slide valve 4 comprising a connecting channel 5 which may be connected with the inlet and the outlet, is provided between the inlet 2 and the outlet 3. The slide valve and the connecting channel are designed such that inlet 2 and outlet 3 are connected with each other in the first position shown in FIG. 1 and are separated in the second position shown in FIG. 2. In order to provide a seal between inlet 2 and slide valve and between slide valve and outlet 3 respective suitable gaskets designed as cooperating flat slide valve gaskets 6, 7 with corresponding sealing rings are provided.

One end 8 of the slide valve 4 extends into a cylinder 9 in which it may reciprocally slide as a piston 12 in dependence on the pressure prevailing within the cylinder.

The interior of the cylinder 9 is connectable with the inlet 2 via a control valve 10 and a connecting conduit 11. The control valve 10 comprises a valve space 13 having a first section 14 and a second section 15. The inlet of the first section is connected with the connecting conduit 11 and the outlet is connected with the second section 15. The second section is formed as bore having the end thereof which is opposite to the first section opening into a bore 16 of the slide valve 4. The bore 16 leads via an exit bore 17 into the environment or into a space 18 in which the environmental pressure or at least a pressure prevails which is lower than a predetermined switching pressure or that pressure of the fluid at the inlet 2, respectively, which shall lead to a changing over of the tube separator or to the movement of the slide valve 4 from the first position shown in FIG. 1 into the second position shown in FIG. 2, respectively.

Furthermore, the second section 15 is connected with the interior 20 of the cylinder 9 via cross bores 19, 19'.

The end of the second section 15 facing the first section as well as the end of the second section 15 facing the bore 16 comprises valve seats 21, 22. A valve rod 23 is provided which passes through the second section 15 and which has a valve body 24 at the end thereof turned away from the first section and a second valve body 25 in a distance from the first valve body which is larger than the distance of both valve seats 21, 22. As may be seen from the Figures the surface area 26 of the second valve body 25 facing the first section 14 is larger than the area 27 of the first valve body 24 which may be acted upon via the second section 15.

The wall of the first section 14 opposite to the second section 15 is formed by a diaphragm 28 having the edge thereof securely clamped. As may be seen from the Figures the valve rod 23 is extended into the first section to such an extent that it passes through the diaphragm and is fixed to an abutment plate 29 and to the diaphragm itself. A compression spring 30 abutting against an abutment 31 is provided at the side of the abutment plate 29 turned away from the diaphragm. This abutment 31 is supported by a spindle 32 secured against displacement relative to the housing. The initial stress of the compression spring may be adjusted by adjusting the abutment 31 along the spindle 32.

The slide valve 4 comprises an abutment plate 33 at the end thereof turned away from the piston 12. A compression spring 35 abutting against a fixed plate 34 engages the abutment plate 33. The abutment plate 33 is laterally guided in a fixed guiding cylinder 36.

In operation the tube separator is mounted in a liquid conduit such that the liquid medium acts upon the inlet 2. The liquid medium passes through the connecting channel 5 and flows to the user via the outlet 3. Simultaneously the fluid flows through the connecting conduit 11. The initial stress of the springs 35 and 30 is selected such that the valve is in the first position shown in FIG. 1, if the pressure within the valve space 13 corresponds to a pressure prevailing at the inlet 2 if the full pressure of fluid prevails at the inlet side. The pressure at the inlet 2 in which the valve shall be kept in the position shown in FIG. 1 is selected by rotating the abutment 31 and thus by adjusting the initial stress of the spring 30. The initial stress of the spring 35 is selected such that for this valve position the slide valve 4 is in the opened position shown in FIG. 1. If the pressure prevailing at inlet 2 drops below a predetermined value the spring 30 displaces the valve via the diaphragm 28 and the valve rod 23 into the second position shown in FIG. 2, in which the first valve section 14 is separated from the second valve section 15 and the cylinder space 20 is connected with the bore 16. Hence, the pressure within the interior of the cylinder decreases such that the spring 35 moves the slide valve 4 into the shut-off position shown in FIG. 2.

In the first valve position shown in FIG. 1 the fluid medium acts upon the diaphragm on the one hand in a direction opposite to the tension of the spring force 30 and on the other hand in a direction of the tension of the spring 30 by acting upon the valve area 27. Since the area of the diaphragm is considerably larger, there is a resulting force in a direction opposite to the tension of spring 30. If the valve changes over into the position shown in FIG. 2, then the medium again exerts a force in a direction opposite to the tension of spring 30 by acting upon the diaphragm and further exerts a force in direction of the tension of spring 30 by acting upon the area 26. Since the area 26 is larger than the area 27, the resulting force in a direction opposite to the tension of spring 30 is smaller than in the first case. This means that the force required for changing back the valve from the second position shown in FIG. 2 into the first position shown in FIG. 1 is larger than the force required for changing over the valve from the position shown in FIG. 1 into the position shown in FIG. 2. In an analogous manner the resulting force increases after changing over the control valve from the second position shown in FIG. 2 into the first position shown in FIG. 1. Hence, this means that the forces acting upon the valve in change-over direction increase after the changing over and keep the valve in the changed-over position. It is thus achieved that the change-over of the control valve and hence of the slide valve 4 takes place in a more defined and quicker manner. It is further achieved that a flutter of the control valve or the slide valve respectively and hence a not clearly defined position of the slide valve in a critical pressure region causing the changing-over of the control valve or the slide valve, respectively, is avoided.

The areas 26 and 27 can be selected small, because according to the invention the control valve 10 is not mounted in a main stream, but in the control circuit extending from the connecting conduit 11 to the channel 16 and having a considerably smaller cross-section. Thereby also the diaphragm 28 and the adjusting means formed by the spring 30, the abutment plate 31 and the spindle 32 can be designed in a small size and in a space-saving manner.

We claim:

1. A tube separator comprising a housing with an inlet and an outlet, a fluid passage connecting said inlet with said outlet, shut-off means between said inlet and said outlet for opening said fluid passage in a first position thereof and closing said fluid passage in a second position thereof, and means for operating said shut-off means, said operating means comprising a pressure chamber connected with said inlet via a fluid line, a pilot valve defining a first side of said pressure chamber and pilot valve operating means defining a second side of said pressure chamber opposite to said first side, said pilot valve connecting the shut-off means with the pressure chamber in a first switching position and with a reduced pressure chamber in a second switching position and comprising a first valve member having a first valve area and cooperating with a first valve seat in said first switching position and a second valve member having a second valve area and cooperating with a second valve seat in said second switching position, said first valve area being smaller than said second valve area, said valve operating means comprising an inlet fluid operated member connected with said pilot valve, said member having a fluid operated area which is larger than said second valve area, whereby said fluid operated member is acted upon by the inlet fluid pressure in a direction opposite to the action of the inlet fluid pressure on said first and second valve members in their respective closed positions.

2. The tube separator of claim 1, comprising preloading means for applying a preload to said member in a direction opposite to the action of the inlet fluid pressure.

3. The tube separator of claim 2, comprising means for adjusting said preload.

* * * * *